US005246162A

United States Patent [19]

Heuberger et al.

[11] Patent Number: 5,246,162

[45] Date of Patent: Sep. 21, 1993

[54] CARDBOARD BOX FOR POURABLE MATERIAL, IN PARTICULAR LIQUIDS

[75] Inventors: Erich Heuberger, Trugenhofen; Michael Fuchs, Dischingen; Helmut Sieber, Heidenheim, all of Fed. Rep. of Germany

[73] Assignee: Carl Edelmann GmbH, Heidenheim, Fed. Rep. of Germany

[21] Appl. No.: 939,677

[22] Filed: Sep. 3, 1992

[51] Int. Cl.[5] ..... B65D 5/54; B65D 5/56

[52] U.S. Cl. ..... 229/216; 220/418; 220/463; 229/217

[58] Field of Search ..... 229/216, 217; 220/416, 220/418, 441, 443, 461, 462, 463

[56] References Cited

U.S. PATENT DOCUMENTS

| | | | |
|---|---|---|---|
| 2,925,949 | 2/1960 | Locke | 229/117.01 |
| 2,959,336 | 11/1960 | Mosse et al. | 220/462 |
| 2,979,247 | 4/1961 | Pellaton et al. | 220/463 |
| 3,003,673 | 10/1961 | Clark et al. | 229/217 |
| 3,136,471 | 6/1964 | Brastad | 220/418 |
| 3,339,820 | 9/1967 | Krzyzanowski | 229/216 |
| 3,366,308 | 1/1968 | Phillips, Jr. | 229/117.01 |
| 3,640,447 | 2/1972 | Forbes, Jr. et al. | 220/418 |
| 3,767,107 | 10/1978 | Forbes, Jr. . | |
| 4,032,060 | 6/1977 | Bergstein | 220/462 |
| 4,327,833 | 5/1982 | Kuchenbecker | 229/216 |

FOREIGN PATENT DOCUMENTS

| | | | |
|---|---|---|---|
| 692562 | 8/1964 | Canada | 220/418 |
| 51803 | 12/1966 | German Democratic Rep. . | |
| 402723 | 5/1966 | Switzerland . | |
| 625181 | 9/1981 | Switzerland . | |
| 759941 | 3/1957 | United Kingdom | 220/463 |
| 1148936 | 5/1963 | United Kingdom . | |
| 2302484 | 8/1973 | United Kingdom . | |

*Primary Examiner*—Gary E. Elkins

*Attorney, Agent, or Firm*—Brooks Haidt Haffner & Delahunty

[57] ABSTRACT

Described is a cardboard box for pourable material, in particular liquids, consisting of a folding box having a rectangular base section and made of cardboard, and an inner bag disposed therein. At its upper end, the body of the folding box is provided with a circumferential collar adapted to be folded inwards for closing the folding box, and a cover flap extending from a portion of the collar for covering the end portion of the inner bag projecting from the collar in its sealed and flattened-down condition in the adhesively secured state of the flap. The cover flap is provided with a portion formed as a tearing tab permitting the folding box to be torn open together with a section disposed therebelow of the upper end portion of the inner bag. In this manner it is possible to form a pouring spout of the type already generally known from milk packages.

10 Claims, 5 Drawing Sheets

CARDBOARD BOX FOR POURABLE MATERIAL, IN PARTICULAR LIQUIDS

BACKGROUND OF THE INVENTION

The invention relates to a cardboard box for pourable material, in particular liquids, consisting of a folding box having a rectangular base section and made of cardboard, and an inner bag of a heat-sealable material disposed in the box and adhesively secured thereto at least at a number of separate locations.

With regard to packing materials for certain liquids, such as detergent concentrates, there is a trend induced by environment protection considerations to increasingly turn away from pure plastic packing materials in favour of card-board packages in combination with thin plastic sheeting, for containing liquids to be decanted by the user into a bottle for subsequent piecemeal consumption.

There have already been developed cardboard packing materials provided with an inner bag made of an aroma-Protective plastic material and having a pouring spout projecting through a cutout in the cardboard box surrounding the inner bag (DE Patent 33 36 269). The production and manipulation of these packaging materials is rather onerous. Since card-board packages are usually supplied to the filling plant in a flattened-down state, and since a pouring spout attached to the inner bag does not, however, permit the package to be laid flat, the pouring spout can only be attached at the filling plant after the package has been unfolded. The supply of packaging materials of this type to he filling plant is hampered by logistic problems.

Known from DE Patent 26 47 025 is a cardboard box with an inner bag, which can be supplied to the filling plant in a pre-confectioned state, i.e. with the inner bag in place, and in the flattened-down configuration, and which in the unfolded and filled state is of a configuration permitting the inner bag to be opened and at the same time a pouring spout to be formed by tearing off a portion of a cover flap together with a portion of the inner bag. This package comprises an inner cover flap acting to close the folding box at its upper end and formed with a transversely extending slot for the sealed end portion of the inner bag to extend therethrough, so that in the closed state of the folding bag the sealed end portion of the inner bag lies partially below and partially above the inner cover flap. The outer cover flap overlies the inner cover flap and is adhesively secured thereto as well as to the portion of the upper end section of the inner bag overlying the inner cover flap. At the location whereat it overlies the last-named portion of the upper end section of the inner bag, the outer cover flap is formed with a tear perforation permitting it to be torn off together with the respective portion of the inner bag. The specifically incorporated provisions are effective to safely retain the inner bag in place as the package is torn open, to thereby facilitate this opening operation.

SUMMARY OF THE INVENTION

It is an object of the invention to provide a cardboard box for pourable material, in particular liquids, which is of simple construction, capable of being produced, set up, filled and closed in a simple manner, and which lends itself to being opened by the consumer in an uncomplicated operation.

The present invention provides a cardboard box for pourable material, in particular a container for liquids. The folding box of the invention is made of cardboard and has a rectangular base section. An inner bag of heat-sealable material is disposed in the folding box and is adhesively bonded to the cardboard at least at a few separate locations. The box has a body comprising two oppositely disposed main faces and two side faces interconnecting the two main faces. The faces are provided at one of their ends with inwards folded flaps having parts thereof adhesively bonded to one another to form the bottom of the box, the other ends of the faces being extended by a circumferential collar defined by a circumferentially extending crease line. The height of the collar does not exceed half the distance between the two main faces. Collar sections extend from the main faces and are folded towards one another so as to form two triangular gussets in combination with respective portions of sections of the collar extending from the side faces. An extended and sealed end portion of the inner bag is guided through the gap between the free edges of the aforesaid collar sections extending from the main faces, and covered thereon by a cover flap provided on the opposite one of the collar sections extending from the other main face and adhesively bonded to the first collar section.

The invention provides a package capable of being closed by the employ of packaging machines similar to the ones known for use in filling and closing milk packages (so-called gable packages). The package can be closed at its bottom end in the conventional manner by the inwards-folding of flaps extending from its body faces, subsequent to its inner bag having been sealed at this location. The characteristics of the invention relate in particular to the upper end of the package configured so as to permit the package to be filled, sealed, closed and subsequently re-opened in a simple manner, with the particularly advantageous aspect that in its closed state the cardboard box package is of a purely parallelepipedic configuration facilitating its being stacked and stowed in bigger containers.

BRIEF DESCRIPTION OF THE DRAWINGS

An embodiment of the invention shall now be described in more detail by way of example with reference to the accompanying drawings, wherein.

DESCRIPTION OF PREFERRED EMBODIMENT

In the following description of the cardboard box package according to the invention, reference will be had to all figures of the drawings.

The cardboard box package consists of a folding box 1 and an inner bag 2 disposed therein. Folding box 1 is made of cardboard, and inner bag 2 consists of a heat-sealable sheet material. The sheet material is preferably a combination of aluminum and paper, with the aluminum layer facing inwards and being coated with polyethylene acting as the sealing material, and the paper layer facing outwards. The aluminum layer is impermeable to oxygen and acts as aroma barrier, and the paper layer acts as the carrying layer of inner bag 2. This combination of materials permits the use of aluminum to be minimized. The combination offers the further advantage that it can be manually torn.

Figure 6:
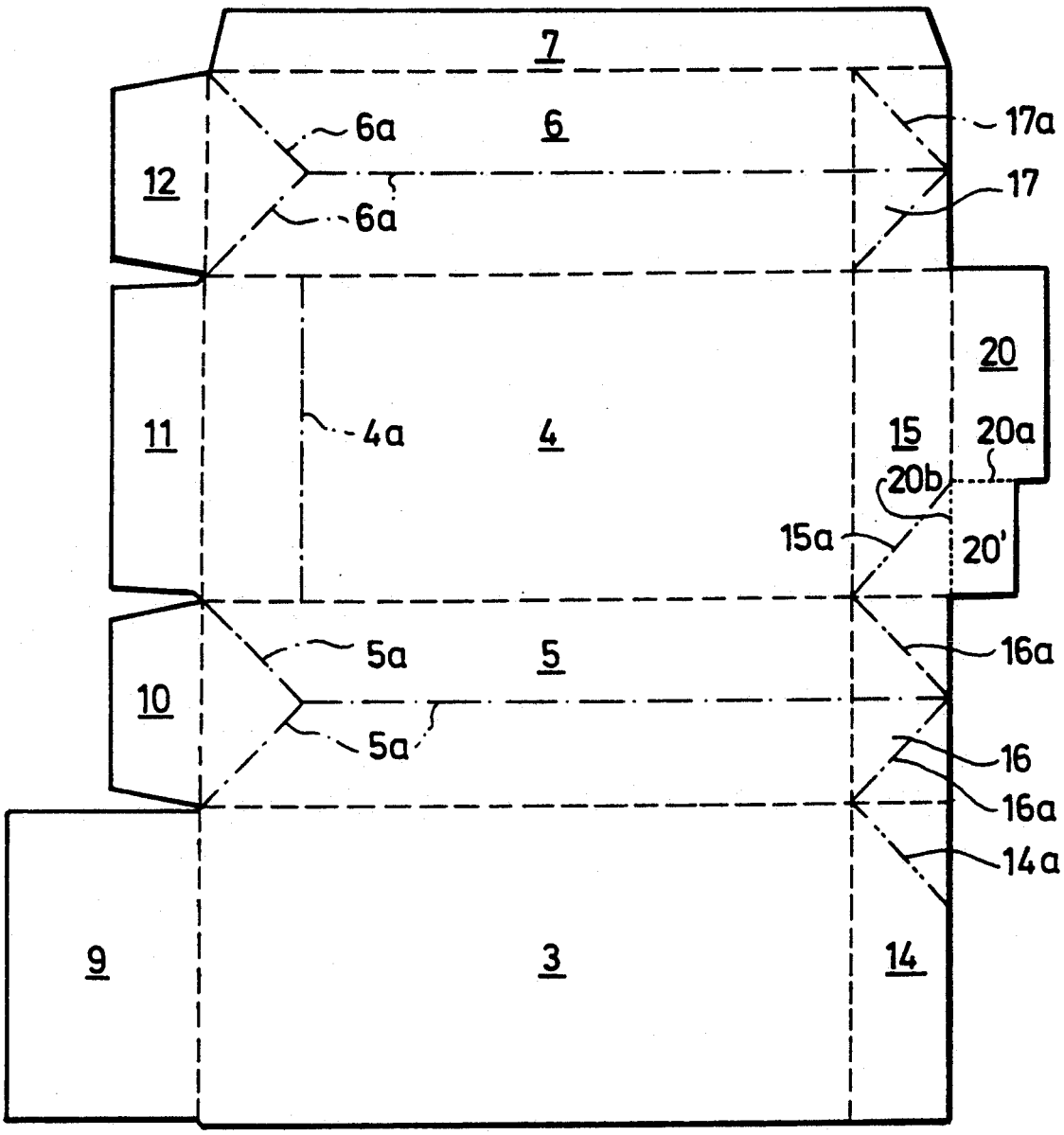
FIG. 6 shows a plan view of the outer side of a blank for the folding box of the package of FIG. 1.

The blank for the folding box shown in FIG. 6 has substantially two rectangular main faces 3 and 4 and two rectangular side faces 5 and 6 cooperating with one another to form a body 8 of the folding box, side face 6 having a glueing flap 7 extending therefrom. Provided on one side of main face 4 and side faces 5 and 6 are narrow closure flaps 11 and 10, 12, respectively, and on main face 3, a wider closure flap 9 to be disposed on the outside of the finished package. In the folded and glued state of the folding box, closure flaps 9 to 12 cooperate with one another to form the bottom of the box in a manner to be reviewed hereinafter.

At the other side forming the upper end of the finished folding box, body 8 is provided with an extension in the form of a collar 13 extending continuously around the circumference of body 8. Collar 13 is composed of first and second collar sections 14 and 15 extending from the main faces, and collar sections 16 and 17 extending from side faces 5 and 6, all collar sections being connected to one another and to glueing flap 7 by respective folding lines.

In FIG. 6, the folding lines devised to form the corners of folding box body 8 and collar 13, respectively, are indicated by dotted lines. As also shown in FIG. 6 by dash-dotted lines 16*a* and 17*a*, collar sections 16 and 17 are provided with respective crease lines wherealong the collar sections are folded inwards as the folding box is being closed (cf. FIGS. 1 and 2). As indicated by double dot-dash lines, collar sections 14 and 15 extending from main faces 3 and 4, respectively, are each formed with an obliquely extending crease line 14*a* and 15*a*, respectively, devised to facilitate the formation of a pouring spout after the package has been torn open, as will be described later.

Connected to collar section 15, itself extending from main face 4, is a cover flap 20 provided with a tear flap portion in the form of a section 20' of reduced height joined to the remainder of cover flap 20 and collar section 15 by respective tear lines 20*a* and 20*b*.

Figure 7:
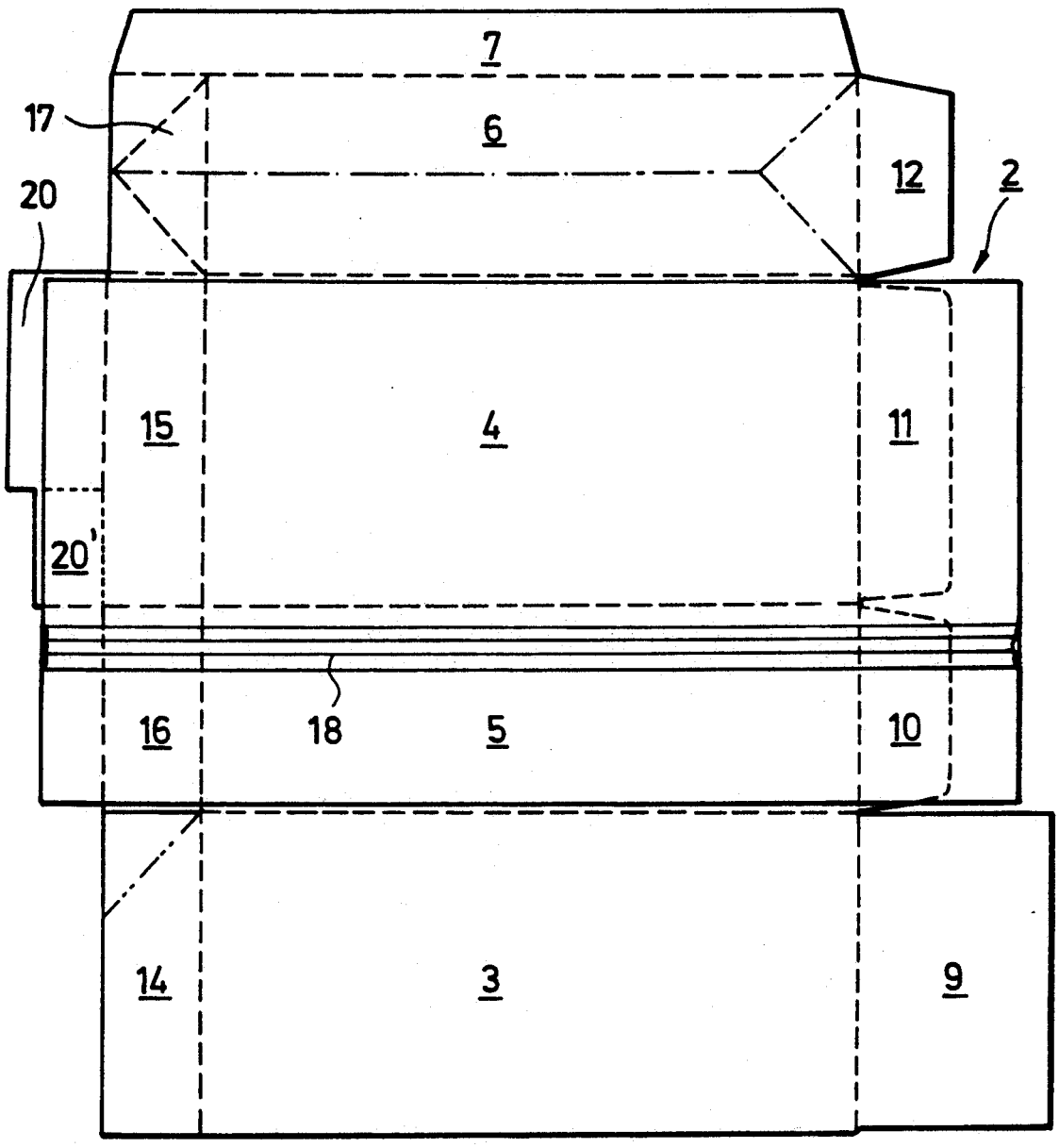
FIG. 7 shows the inner side of the blank with a length of a tubular sheet disposed thereon for the formation of the inner bag.

As shown in FIG. 7, inner bag 2 is made of a flat-lying sheet material welded to a tubular shape along a longitudinal weld seam 18. In the production of the cardboard box package of FIG. 1, a length of the thus formed tubular sheet is placed on the side of main face 4 and side face 5 forming the inner wall surface of the folding box, and adhesively secured thereto at selected locations, preferably only adjacent the crease lines between the body and bottom flaps and the collar, respectively. This adhesive fixation serves to retain the tubular sheet section on the folding box blank and to ensure that the tubular sheet section is properly set up together with the folding box immediately prior to the filling operation at the filling plant. The adhesive fixation should not be any stronger than absolutely required for this purpose, and should in particular be sufficiently light to permit the empty inner bag to be readily separated from the folding box after use of the package, so that the components of the package can be separately reclaimed.

As shown in FIG. 7, the length of the tubular sheet section is selected so that one of its ends extends to a location just below tear flap 20', but not therebeyond, and the other end extends over bottom flaps 10 to 12, but not over the larger bottom flap 9.

Figure 4:
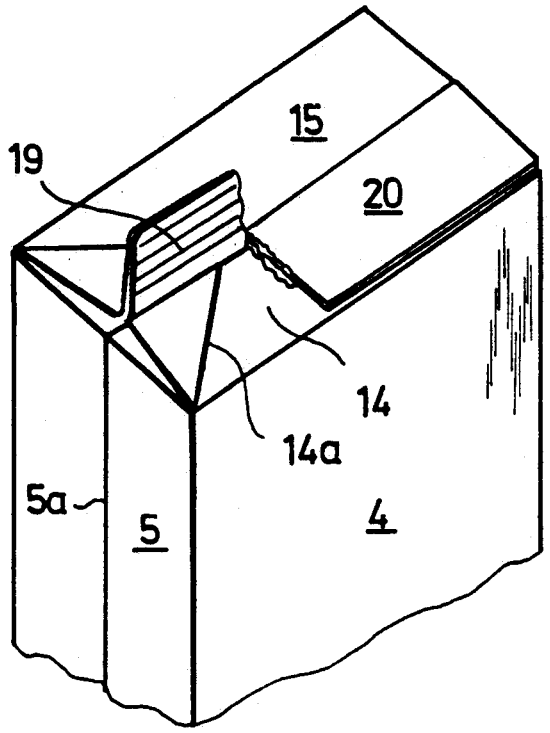
FIG. 4 shows the cardboard box package of FIG. 3 in the partially opened state.

Collar sections 15 and 16 are adhesively connected to the tubular sheet section in surface contact therewith an in a releasable manner. The state as far as described is shown in FIG. 4. Proceeding from this state, the other main face 3 and side face 6 are folded up and adhesively connected to the tubular sheet length, similarly in a releasable manner. Glueing flap 7 then underlies main face 3 and the attached collar section 14, and is adhesively secured thereto, likewise in a releasable manner. In the thus established, part-glued and flat-lying state the package is ready for shipment to the filling plant.

At the filling plant, the partly glued folding box is set up, causing the tubular sheet section to unfold as a result of its being adhesively secured to the folding box. The end of the tubular sheet section adjacent bottom flaps 9 to 12 is then heat-sealed in the conventional manner and folded back into the folding box. The flaps 10 and 12 extending from side faces 5 and 6 are then folded inwards in conventional manner, subsequently the bottom flap 11 extending from main face 4 is similarly folded inwards, and finally the larger bottom flap 9 extending from main face 3 is folded inwards and adhesively connected to bottom flap 11. In this state, illustrated in FIG. 1, the cardboard box package is ready for being filled.

After the package has been filled, the end section of inner bag 2 projecting above collar 13 is folded in and heat-sealed in the usual manner. The collar sections 16 and 17 extending from side faces 5 and 6 are now pushed inwards so as to fold in along their obliquely extending crease lines 16*a* and 17*a*. As a result, the free edges of collar sections 14, 16 and 17 approach one another, with the sealed end portion 19 of inner bag 2 projecting through the gap remaining between collar sections 14 and 15. This state is illustrated in FIG. 2.

Figure 2:
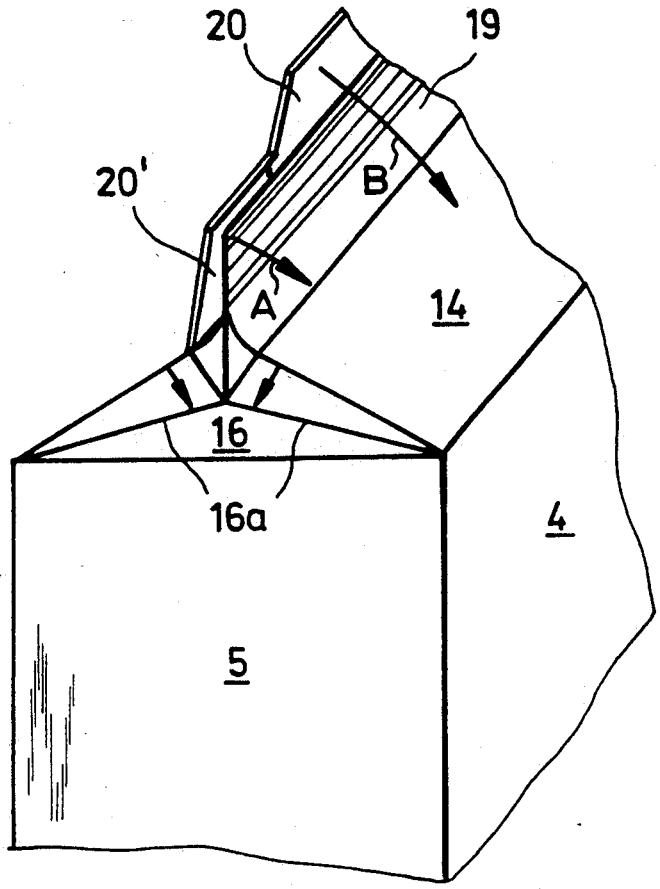
FIG. 2 shows a detail of the cardboard box package of FIG. 1 in the filled state, with the inner bag already sealed and prior to the folding box being closed.
Figure 3:
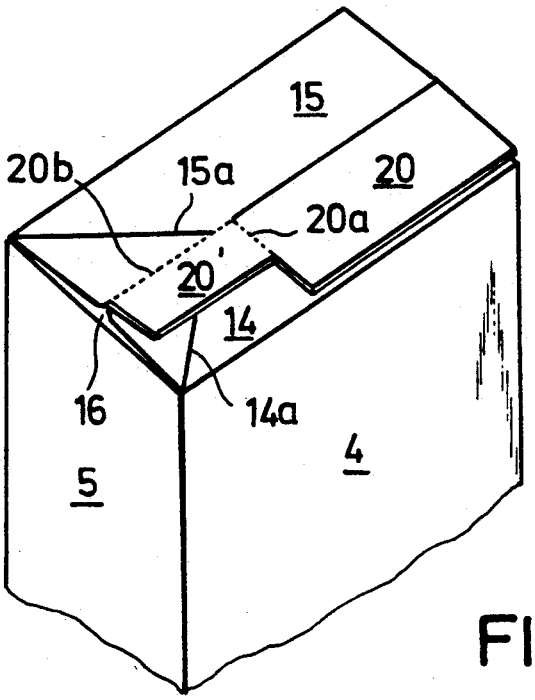
FIG. 3 shows the top portion of the cardboard box package in the completely closed state.

The sealed end portion 19 of inner bag 2 is then flattened down onto collar section 14 as indicated by the arrow A in FIG. 2. Subsequently the cover flap 20 provided on collar section 15 is folded down thereonto as indicated by the arrow B in FIG. 2. These two folding steps can be carried out in a single operation. The thus achieved final state is illustrated in FIG. 3.

From FIG. 4 it is evident that a part of cover flap 20 overlies inner bag 2, since the latter extends, as already mentioned, no further than the tear tab 20' formed on cover flap 20. As cover flap 20 is folded down, its marginal portion projecting beyond end portion 19 of inner bag 2 is adhesively secured to collar section 14. At the same time the section of the end portion 19 of inner bag 2 not underlying tear tab 20' may also be adhesively secured to collar section 14. This can be accomplished without difficulty, inasmuch as the outer paper layer of inner bag 2 has good bonding properties. In the closed state of the cardboard box package as shown in FIG. 3, inner bag 2 is completely covered by the cardboard material.

Opening of the package solely requires tear tab 20' to be torn off, together with the underlying section of the sealed end portion 19 of inner bag 2. This is facilitated by the tearing perforations 20*a* and 20*b*. Should the inner bag 2 be made of a rather tough material having a high tear resistance, the package may be opened in successive steps. In a first step, tear tab 20' is torn off, giving access to the underlying section of end portion 19 of the inner bag. In this state it is generally possible to tear the bag, even if it is made of a tough material, at least perpendicular to its marginal edge, because the sealing operation in the marginal portion has caused certain changes in the material which permit the edge portion to be manually torn. This condition is depicted in FIG. 4. The now freely projecting section of end portion 19 may the be cut off with a knife of a pair of scissors, unless it can be torn off.

Figure 5:
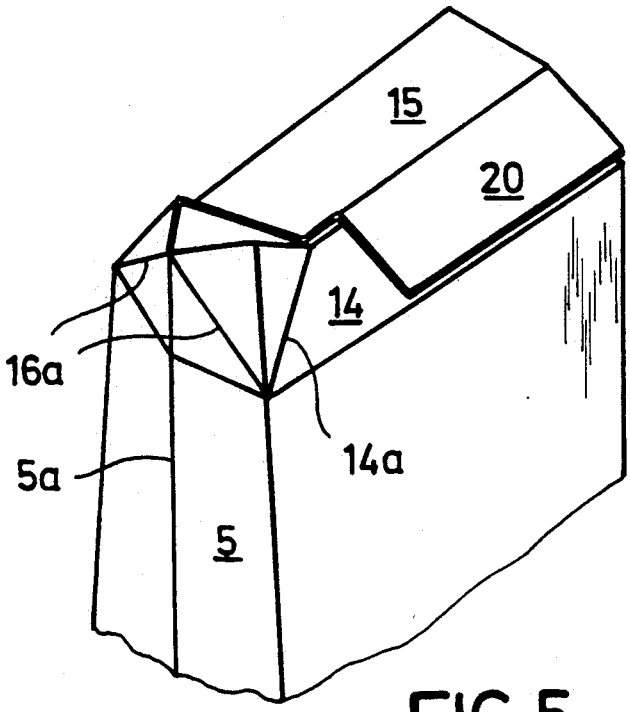
FIG. 5 shows the cardboard box package of FIGS. 3 and 4 in the completely opened state ready for being emptied.

Subsequently collar section 16 may be folded outwards so as to form a pouring spout projecting above the still partially closed top end of the package. The formation of this pouring spout is facilitated by the obliquely extending crease lines 14*a* and 15*a* in collar sections 14 and 15. This state is illustrated in FIG. 5.

After the package has been completely emptied, cover flap 20 may be torn fully open to give free access to inner bag 2, whose readily releasable adhesive bondings permit it to be extracted from folding box 1 for separate reclamation.

Figure 1:
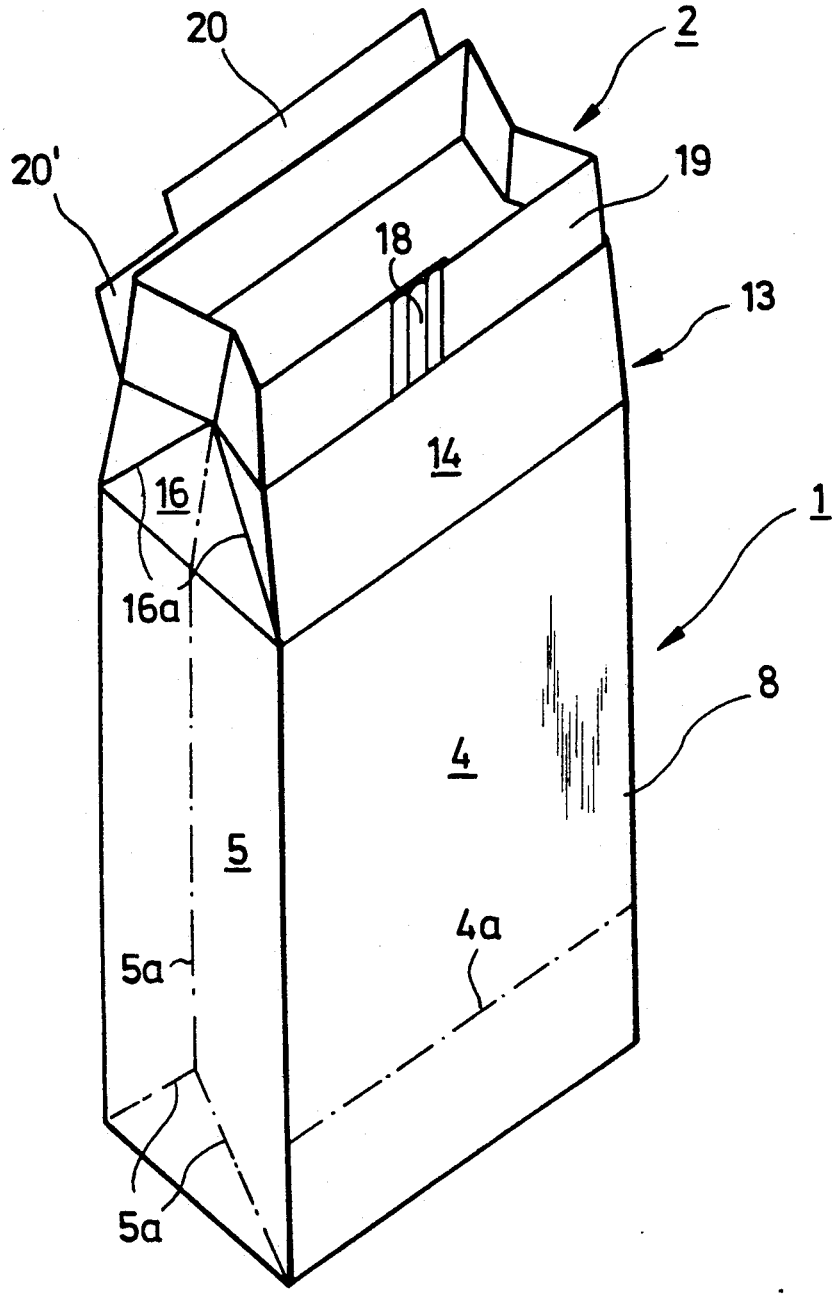
FIG. 1 shows a perspective view of a cardboard box package according to the invention in the unfolded and partially sealed state ready for being filled.

Attention shall now be directed to the crease lines 4*a*, 5*a* and 6*a* provided on main face 4 and side faces 5 and 6. These crease lines are intended to permit the emptied folding box 1 to be folded flat without having to be torn any further. Side faces 5 and 6 are folded inwards along crease lines 5*a* and 6*a*, whereupon the bottom can be folded upwards to a flattened state along crease line 4*a*, the latter being preferably formed at the innerface of the cardboard material of main face 4 so as not to detract from the appearance of the package. Since crease lines 5*a* and 6*a* fully extend into collar sections 16 and 17 as shown in FIGS. 1 and 6, the upper end portion, i.e. the top cover portion of the folding box can also be folded flat, to which purpose the upper end of the folding box is advantageously torn completely open, which is readily accomplished thanks to its having already been partially opened. In this manner the bulk of the emptied package may be reduced to facilitate its reclamation.

We claim:

1. A cardboard box for pourable material, consisting of a folding box made of cardboard with a rectangular base section, and an inner bag of a heat-sealable material disposed in said folding box and adhesively bonded to the cardboard at at least a few separate locations, said folding box having a body comprising two spaced main faces and two side faces interconnecting said main faces, said main and side faces each having first and second ends, and being provided at their first ends with inwards folded flaps with portions of said flaps being adhesively bonded to one another to form a bottom of said folding box, their second ends being extended by a circumferential collar defined by a circumferentially extending crease line and being of a height not exceeding half the distance between said two main faces, said collar comprising collar sections extending from said main faces and being folded towards one another so as to form two triangular gussets in cooperation with respective portions of collar sections extending from said side faces, said collar sections extending from said main faces defining a gap therebetween for an extended and sealed end portion of said inner bag to pass therethrough, said end portion being laid down on a first one of said collar sections extending from said main faces, and covered thereon by a cover flap provided on an opposite second one of said collar sections extending from the other main face, and adhesively bonded to said first collar section, said cover flap being provided with a tear tab offset from a remainder of said cover flap and from said second collar section by respective tear lines and being of a height smaller than a height of said cover flap, said sealed end portion of said inner bag being of a height not exceeding the height of said tear tab.

2. A cardboard box according to claim, 1 wherein said sealed end portion of said inner bag underlying the remainder of said cover flap is adhesively bonded to a collar section covered by said sealed end portion.

3. A cardboard box according to any of the preceding claims, wherein each of said side faces is provided with a crease line extending longitudinally from said bottom to said collar for facilitating folding inwards of the side faces, and bifurcating out at a spaced location above said bottom to extend towards corners at the bottom of said folding box.

4. A cardboard box according to claim 3, wherein one of said main faces is provided with a transversely extending crease line at a level of said spaced location above said bottom.

5. A cardboard box according to claim 1, wherein said collar sections extending from said main faces have portions adjacent said tear tab formed with obliquely extending crease lines terminating in respective adjacent corners of said folding box.

6. A cardboard box according to claim 1, wherein said inner bag is adhesively bonded to said collar in surface contact therewith.

7. A cardboard box according to claim 1, wherein said inner bag is adhesively bonded to said cover flap inclusive of said tear tab in surface contact therewith.

8. A cardboard box according to claim 1 or 2, wherein said inner bag consists of an aluminum-paper laminate, with an aluminum layer facing inwards and being coated with polyethylene acting as a sealing material.

9. A cardboard box according to claim 1 or 2, wherein said inner bag consists of a flat-lying sheet material welded to a tubular shape, with a weld seam extending parallel to one of said main faces from said bottom to said collar of said folding box.

10. A cardboard box according to claim 1 or 2, wherein all of the adhesive bonds between said folding box and said inner bag are readily releasable by tearing.

* * * * *